US007487835B2

(12) United States Patent
Carter, Jr. et al.

(10) Patent No.: US 7,487,835 B2
(45) Date of Patent: Feb. 10, 2009

(54) METHOD OF DEVELOPING A RE-ENTRY INTO A PARENT WELLBORE FROM A LATERAL WELLBORE, AND BOTTOM HOLE ASSEMBLY FOR MILLING

(75) Inventors: Thurman B. Carter, Jr., Houston, TX (US); Robert E. Robertson, Bakersfield, CA (US); Hubert E. Halford, Rosharon, TX (US); Thomas M. Redlinger, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 619 days.

(21) Appl. No.: 10/850,046

(22) Filed: May 20, 2004

(65) Prior Publication Data

US 2005/0257930 A1 Nov. 24, 2005

(51) Int. Cl.
*E21B 29/06* (2006.01)

(52) U.S. Cl. ..... 166/298; 166/313; 166/50; 166/55.7

(58) Field of Classification Search ..... 166/50, 166/55, 55.6, 55.7, 298, 313, 55.3
See application file for complete search history.

(56) References Cited

U.S. PATENT DOCUMENTS 4,266,621 A * 5/1981 Brock ..... 166/55.3
4,618,009 A 10/1986 Carter
4,717,290 A 1/1988 Reynolds
5,253,710 A 10/1993 Carter
5,341,873 A 8/1994 Carter
5,409,060 A 4/1995 Carter
5,425,417 A 6/1995 Carter
5,429,187 A 7/1995 Beagrie
5,452,759 A 9/1995 Carter (Continued)

FOREIGN PATENT DOCUMENTS

EP 1 336 720 8/2003

(Continued)

OTHER PUBLICATIONS

U.K. Search Report, Application No. GB0510223.1, dated Jul. 14, 2005.

(Continued)

*Primary Examiner*—Richard E Chilcot, Jr.
*Assistant Examiner*—Matthew J Smith
(74) *Attorney, Agent, or Firm*—Patterson & Sheridan, L.L.P.

(57) ABSTRACT

A method is provided that allows the operator to re-enter a primary wellbore from a lateral wellbore after the lateral wellbore has been completed. The method generally comprises the steps of locating a cutting device such as a milling bit adjacent a tubular such as a liner within a wellbore, rotating the milling bit while maintaining an axial position of the milling bit relative to the liner to initiate an opening, and rotating and axially advancing the milling bit to complete the opening. In addition, a bottom hole assembly that facilitates re-entry into the primary wellbore from a lateral wellbore is provided. The bottom hole assembly generally includes a drill collar or other heavy pipe structure, and a mill. The mill has a body and cutting structures. The cutting structures apply lateral force against a surrounding pipe to form an initial lip through the wall of the pipe.

42 Claims, 8 Drawing Sheets

U.S. PATENT DOCUMENTS 5,522,461 A 6/1996 Carter
5,531,271 A 7/1996 Carter
5,620,051 A 4/1997 Carter
5,720,349 A 2/1998 Pleasants
5,727,629 A 3/1998 Blizzard, Jr.
5,732,770 A 3/1998 Beeman
5,743,331 A 4/1998 Adkins
5,787,978 A 8/1998 Carter
5,791,417 A 8/1998 Haugen
5,803,176 A 9/1998 Blizzard, Jr.
5,806,595 A 9/1998 Langford
5,826,651 A 10/1998 Lee
5,836,387 A 11/1998 Carter
5,862,870 A 1/1999 Hutchinson
5,887,655 A 3/1999 Haugen
5,984,005 A 11/1999 Hart
6,024,168 A 2/2000 Kuck
6,035,939 A 3/2000 Carter
6,039,118 A 3/2000 Carter
6,056,056 A 5/2000 Durst
6,070,665 A 6/2000 Singleton et al.
6,070,670 A 6/2000 Carter
6,092,601 A 7/2000 Gano
6,112,812 A 9/2000 Carter
6,116,336 A 9/2000 Adkins et al.
6,135,206 A * 10/2000 Gano et al. ..... 166/55
6,155,349 A 12/2000 Robertson
6,170,576 B1 1/2001 Brunnert
6,202,752 B1 3/2001 Kuck
6,209,636 B1 4/2001 Roberts
6,364,037 B1 4/2002 Brunnert
6,374,918 B2 4/2002 Roberts et al.
6,474,415 B1 11/2002 Ohmer
6,547,006 B1 4/2003 Kuck
6,550,551 B2 4/2003 Brunnert
6,591,905 B2 7/2003 Coon
6,695,056 B2 2/2004 Haugen
2002/0195243 A1 12/2002 Hart
2003/0037930 A1 2/2003 Coon
2003/0132032 A1 7/2003 Metcalfe
2003/0141063 A1 7/2003 Haugen
2003/0196819 A1 10/2003 Coon
2004/0159466 A1 8/2004 Haugen

FOREIGN PATENT DOCUMENTS

WO WO 03/087524 A1 10/2003

OTHER PUBLICATIONS

CA Office Action, Application No. 2,507,787, Dated Jan. 23, 2007.

* cited by examiner

METHOD OF DEVELOPING A RE-ENTRY INTO A PARENT WELLBORE FROM A LATERAL WELLBORE, AND BOTTOM HOLE ASSEMBLY FOR MILLING

BACKGROUND OF THE INVENTION

1. Field of the Invention

Embodiments of the present invention generally relate to the practice of sidetrack drilling for hydrocarbons. More specifically, this invention pertains to a method of developing a re-entry into a parent wellbore from a lateral wellbore. The present invention also relates to a bottom hole assembly for providing re-entry into a parent wellbore.

2. Description of the Related Art

In recent years, technology has been developed which allows an operator to drill a primary vertical well, and then drill an angled lateral borehole off of the primary well at a chosen depth. Generally, the primary vertical wellbore is first cased with a string of casing and cemented. Then a tool known as a whipstock is positioned in the casing at the depth where deflection is desired. The whipstock is specially configured to divert milling bits and then a drill bit in a desired direction for forming a lateral borehole. This process is sometimes referred to as sidetrack drilling.

FIGS. 1A-1G present sequential steps for one known method of forming a lateral wellbore. FIG. 1A presents a partial cross-sectional view of a wellbore 100. The wellbore 100 in this initial step comprises only a primary wellbore 10. The primary wellbore 10 is an essentially vertically formed wellbore extending downward through the earth formation 30. The primary wellbore, or "parent" wellbore 10, is lined with generally tubular casing 12. A cement column 14 fills an annular area radially between the casing 12 and the earth 30.

An anchoring device 50 such as an anchor-packer has been set in the primary wellbore 10. The packer 50 grippingly engages the surrounding casing 12, enabling the packer 50 to act as an anchor against which tools above it may be urged to activate different tool functions. The illustrative packer 50 of FIG. 1A includes an orientation indicating member 52 secured at its top. The orientation indicating member's 52 orientation is checked by running a tool such as a gyroscope indicator or measuring-while-drilling device into the primary wellbore 10.

A whipstock 40 has also been run into the wellbore 100. The whipstock 40 preferably has a stinger 74 (see FIG. 1F) located at the bottom of the whipstock 40. The stinger engages the orientation indicating member 52 of the packer 50. In one procedure, splined connections between the stinger and the orientation indicating member facilitate correct stinger orientation. The stinger allows a concave face 42 of the whipstock 40 to be oriented so as to direct the milling operation in the proper azimuth. In this way, the whipstock 40 is oriented onto the packer 50 so that the upper concave face 42 is downwardly inclined in a desired direction for milling a window 18 through the casing 12 and for drilling the lateral wellbore 20.

A working string 70 has also been lowered into the wellbore 100. The working string 70 may be coiled tubing, drill collars, or other tubular member. A pilot mill 72 is shown attached to a bottom end of the working string 70. The pilot mill 72 includes blades around a radial body of the mill 72 for engaging and cutting the casing 12. In this respect, the milling bit 72 is lowered into the parent wellbore 10 and urged against the upper face 42 of the whipstock 40, thereby forcing the milling bit 72 to deflect in the desired direction to form a window through the casing 12 and the cement 14.

In one illustrative procedure, the whipstock 40 includes an upper pilot lug 41. The working string 70 lowers the milling bit 72 and the whipstock 40 into the primary wellbore 10 together by means of a temporary connection with the pilot lug 41. FIG. 1A shows a shearable setting stud 43 between the pilot mill 72 and the pilot lug 41. In this way, the need for separate trips for running various tools is avoided.

U.S. Pat. No. 6,112,812 discloses a mill which is releasably secured at the top of the whipstock, e.g. with a shearable setting stud connected to a pilot lug on the whipstock. The mill and whipstock can then be lowered into the wellbore together. Rotation of the string rotates the mill, and causes shearing of the connection with the whipstock. In addition, U.S. Pat. No. 6,695,056 provides methods for single-trip milling and drilling of a window and lateral wellbore. These patents are referred to and incorporated herein in their respective entireties by reference.

FIG. 1B shows a next step in the formation of a lateral wellbore 20, in one embodiment. Here, the milling bit 72 is being urged against the whipstock 40 so as to frictionally engage the surrounding casing 12. Rotation of the string 70 with the pilot mill 72 rotates the mill 72, causing the connection, e.g., a single bolt shear lug (not shown), with the whipstock 40 to be sheared. The mill 72 is moved downwardly while contacting the pilot lug 41 and then the concave face 42. This urges the starting mill 72 into contact with the casing 12. Milling of the casing 12 is achieved by rotating the tool 72 against the inner wall of the casing 12 while at the same time exerting a downward force on the drill string 70 against the concave face 41 of the whipstock 40. In FIG. 1B, the milling bit 72 has breached the surrounding casing 12 of the primary wellbore 10. The milling bit 72 will continue to work against the casing 12 until a window 18 begins to be formed.

It is not uncommon for the operator to deploy a series of milling bits during a window formation operation. FIG. 1C shows that the original milling bit 72 has been removed from the wellbore 10, and that the working string has been again run into the primary wellbore 10, but with a new milling bit 72' disposed at its end. In addition, a watermelon mill 75 is optionally placed along the working string 70 above the second milling bit 72'. Thus, a fuller window 18 may be formed. The milling bits 72', 76 are rotated until a window 18 is fully formed in the surrounding casing 12 of the primary wellbore 10. The formed window 18 is commonly elliptical, and is dimensioned to allow a drill bit 78 (seen in FIG. 1D) to then be run through the formed window 18 and engaged with the formation 30. In this way, a new lateral wellbore 20 may be formed.

After the window 18 has been formed, the working string 70 and connected mill 72 are pulled from the primary wellbore 10. Thereafter, the working string 70 is again run into the wellbore 100, but with a drilling assembly. The drilling assembly includes a formation drill bit 78. The drill bit 78 is run into the lateral wellbore 20 for drilling of the formation. FIG. 1D shows this next sequential step in the formation of a lateral wellbore 20.

When the desired length of the lateral wellbore 20 is achieved, a generally tubular liner 28 (seen in FIG. 1G) is inserted into the casing 12. The liner 28 is lowered through the parent wellbore 10, deflected radially outward through the window 18, and positioned appropriately within the lateral wellbore 20. A curvature 45 is formed in the liner 28 at the intersection of the primary wellbore 10 and the lateral wellbore 20.

In one procedure, deflection of the liner 28 into the lateral wellbore 20 is by means of the whipstock 20. This procedure is demonstrated in U.S. Pat. No. 5,803,176, entitled "Sidetracking Operations," issued in 1998 to William A. Blizzard, Jr. et al. The '176 patent was a continuation-in-part of Ser. No. 642,118 dated May 2, 1996, which in turn was a continuation-in-part of Ser. No. 590,747 dated Jan. 24, 1996. Ser. No. 590,747 issued on Mar. 17, 1998 as U.S. Pat. No. 5,727,629, also to William A. Blizzard, Jr. et al. The '629 patent is entitled "Wellbore Milling Guide and Method." A softer central core material (not shown) may fill the tubular body of the whipstock 40. In this way, the central core of the whipstock may be drilled out for access to the primary wellbore 10 below the window 18.

In an alternate procedure, a bent joint or hydraulic kick-over joint (not shown) is placed at the bottom of the liner string 28. The joint is biased to exit the window 18 upon reaching the depth of the window 18. This allows the liner 28 to be placed in the wellbore 100 without need of the whipstock 20 (or other deflector). Thus, in more recent procedures the whipstock 20 is pulled before the liner 28 is run into the wellbore 100.

FIG. 1E shows the working string 70 having been pulled from the wellbore 100. A new working string 80 is being lowered into the primary wellbore 10. The working string 80 may be coiled tubing, wireline, or other known string. A fishing hook 82 is disposed at an end of the working string 80. The purpose of the fishing hook 82 is to retrieve the whipstock 40 from the primary wellbore.

FIG. 1F shows the fishing hook 82 engaging the whipstock 40. The whipstock 40 is now being pulled from the packer 50 and attached orientation member 52.

In FIG. 1G it can be seen that the whipstock 40 has been removed from the parent wellbore 10. Where a whipstock is not maintained in the primary wellbore 10, a kick-out sub or other tool (not shown) may be used to urge the liner 28 through the window 18. The liner 28 is placed at the intersection of the parent wellbore 10 and the lateral wellbore 20. The liner 28 may be secured against displacement relative to the casing 12 by a conventional liner hanger, shown at 16. The liner hanger 16 is attached to the liner 28 and grippingly engages the casing 12 of the parent wellbore 10 above the window 18. In the completion of FIG. 1G, the liner 28 is not cemented into place. However, it is understood that the liner 28 may be sealed within the casing 12 of the parent wellbore 10, the earth formation 30, and the lateral wellbore 20 by injecting cement 25 into the liner 28, and then squeezing the cement back upwards into the annular areas surrounding the liner 28. In this way, a cement column is formed around the liner 28.

It may be readily seen that an upper portion of the liner 28 overlaps the casing 12 above the window 18. In this manner, fluid, tools, tubing, and other equipment (not shown) may be conveyed downward from the earth's surface, through an upper portion 6 of the parent wellbore 10, into an upper portion 4 of the liner 28, and thence through the window 18 and into the lateral wellbore 20. The lateral wellbore 20 portion of the subterranean well 100 may, thus, be completed (i.e., perforated, stimulated, gravel packed, etc.).

In the completion of FIG. 1G, the liner 28 includes a slotted liner 27. However, this is purely for purposes of illustration. A solid tubular for later perforation could alternatively be employed. In addition, the liner 28 is preferably cemented into the lateral wellbore 20 by a column of cement 24. In addition, it is understood that other methods of milling a window and forming a lateral wellbore are known. The steps of FIGS. 1A-1G are illustrative, and the methods of the present invention are not limited by the steps taken to form the lateral wellbore or to install a liner 28.

It is known to re-enter the primary wellbore 10 below the window 18 by milling out a portion of the liner 28. U.S. Pat. No. 6,202,752 entitled "Wellbore Milling Methods" discloses one such method. The '752 patent issued to Kuck, et al., in 2001, applies weight to the drill string to cause axial movement during milling. Before that, U.S. Pat. No. 5,803,176 entitled "Sidetracking Operations" was issued. That patent issued to Blizzard, Jr., et al., in 1998. Blizzard, Jr. employed various versions of a mill guide during milling. However, a need yet exists for an improved method that allows the operator to re-enter the primary wellbore from the lateral wellbore. In addition, a need exists for a bottom hole assembly that facilitates re-entry into the primary wellbore.

SUMMARY OF THE INVENTION

The present invention generally provides a method that allows the operator to re-enter a primary wellbore after a lateral wellbore has been completed. In addition, the present invention provides for a bottom hole assembly that facilitates re-entry into the primary wellbore from a lateral wellbore.

In one embodiment, the method generally comprises the steps of locating a cutting device such as a milling bit adjacent a tubular such as a liner within a wellbore, rotating the milling bit while maintaining an axial position of the milling bit relative to the liner to initiate an opening, and then rotating and axially advancing the milling bit to complete the opening. In one embodiment of the method, the milling bit is used to form an opening within a liner at the intersection between a primary wellbore and a lateral wellbore. The milling bit is run into the primary wellbore at the end of a working string, and is located at a point along the curvature of the liner. The milling bit may then be rotated until the liner is entirely breached, thereby forming a lip. Thereafter, the milling bit is axially advanced and rotated to form the re-entry path the in the primary wellbore.

In one arrangement, the method further comprises the step of applying a lateral pressure through the milling bit against the curvature of the liner while rotating the milling bit to initiate the opening. This lateral pressure is directed through the milling bit against the curvature of the liner by a moment force generated by stiffness within the bottom hole assembly. A hydraulically actuated centralizing mechanism may also be used to provide lateral pressure.

In another embodiment of the method, an additional step of reciprocating the milling bit along a length of the curvature of the liner while rotating the milling bit is provided. This step is practiced prior to the step of rotating the cutting device while maintaining an axial position of the cutting device relative to the wall, thereby shaving an inner portion of the liner.

In addition, a bottom hole assembly that facilitates re-entry into the primary wellbore from a lateral wellbore is provided. The bottom hole assembly generally includes a drill collar, a sub connected to the drill collar, and a lead mill. The lead mill has a body connected to the sub, and blades. The blades are dimensioned to increase lateral contact pressure between the blades and the surrounding tubular.

In one arrangement, the sub has an outer diameter that is smaller than the outer diameter of cutting blades along the lead mill. The outer diameter of the sub is preferably tapered to become smaller from the drill collar to the lead mill.

In one arrangement, the bottom hole assembly includes an angled tool joint to create additional deflection of the mill against the liner. The angled tool joint may be a bent sub, a bent extension sub, or a bent upper mill. Alternatively, the lead mill may have a cutting structure that is eccentrically arranged. The eccentric arrangement will increase the lateral load on the surrounding liner by amplifying the deflection of the mill against the liner during rotation.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1A presents a partial cross-sectional view of a wellbore. The wellbore in this initial step comprises only a primary wellbore. The primary wellbore is an essentially vertically formed wellbore extending downward through the earth formation.

FIG. 1B shows the next sequential step in the formation of a lateral wellbore, in one embodiment. Here, a milling bit is being urged against the concave face of a whipstock so as to frictionally engage the surrounding casing.

FIG. 1C demonstrates that the original milling bit has been removed from the wellbore, and a working string has been run into the primary wellbore with a new milling bit. In addition, a watermelon mill is placed along the working string above the second milling bit.

FIG. 1D again shows a cross-sectional view of the wellbore of FIG. 1A. Here, a drilling assembly including a formation drill bit has been run into the lateral wellbore.

FIG. 1E shows the working string having been pulled from the wellbore of FIG. 1D. A new working string is being lowered into the primary wellbore, with a fishing hook disposed on the working string.

FIG. 1F shows the fishing hook from FIG. 1E engaging the whipstock. The whipstock is now being pulled from the wellbore.

FIG. 1G shows yet a next progressive step in the formation of a lateral wellbore and the completion of the well. Here, the whipstock of FIG. 1F has been removed from the parent wellbore. A liner has been positioned at the intersection between the parent wellbore and the lateral wellbore, and has been directed through the window and into the lateral wellbore.

DETAILED DESCRIPTION OF THE PREFERRED EMBODIMENT

Figure 1C:
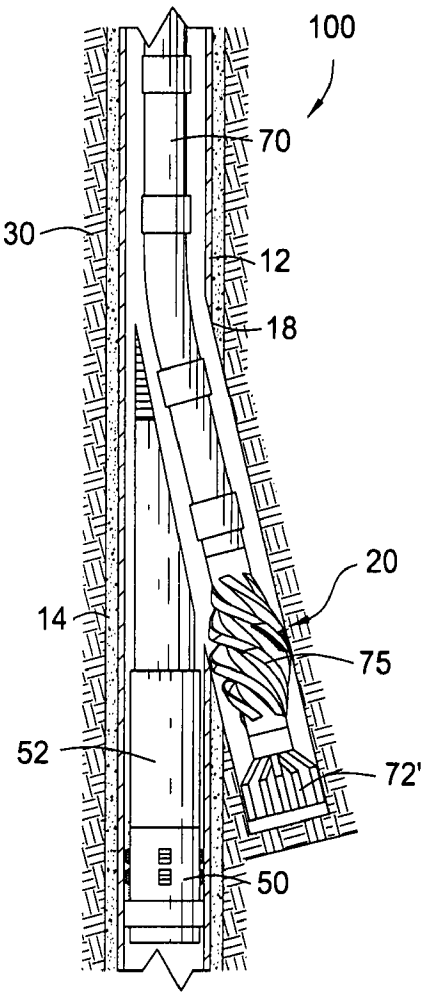
FIG. 1C (PRIOR ART)
FIGS. 1A-1G present sequential steps of one known method for forming a lateral wellbore.
Figure 1B:
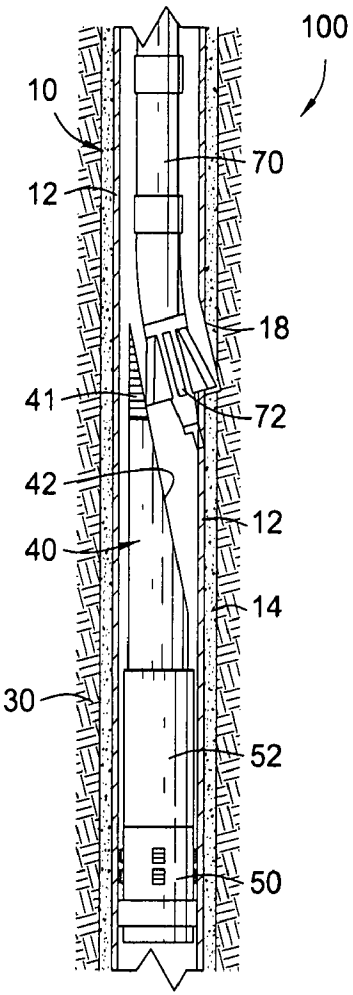
FIG. 1B (PRIOR ART)
Figure 1A:
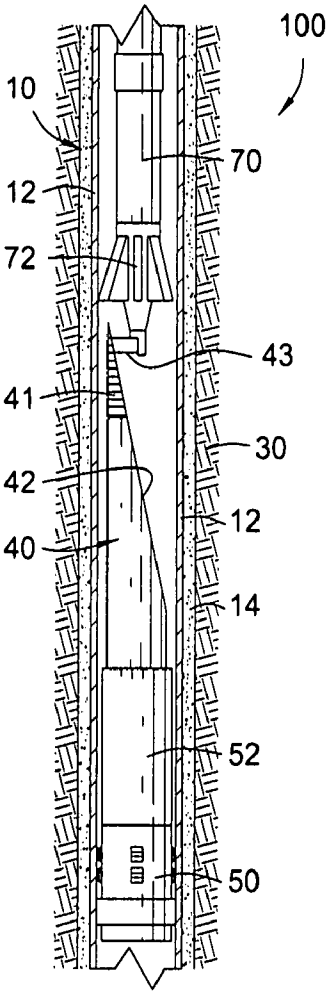
FIG. 1A (PRIOR ART)
Figure 1F:
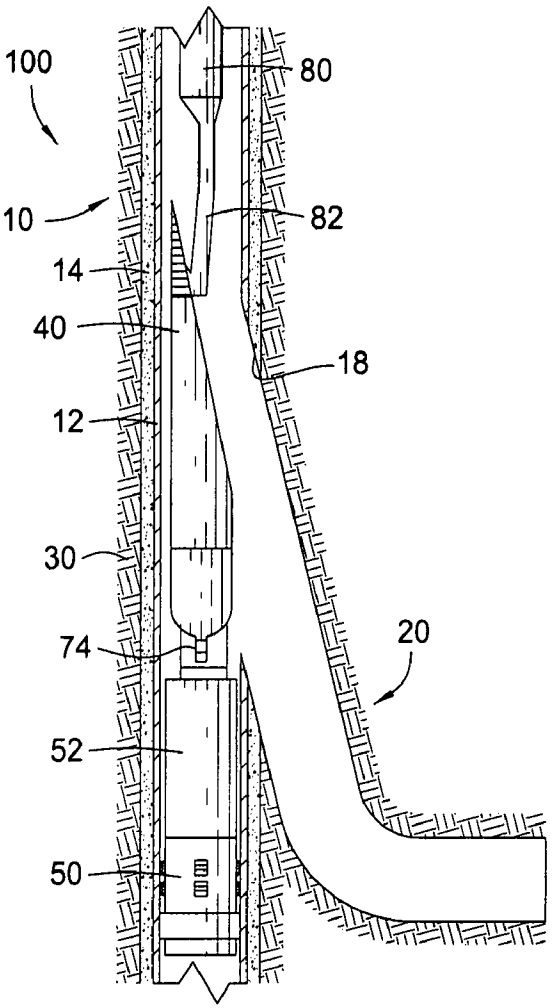
FIG. 1F (PRIOR ART)
Figure 1E:
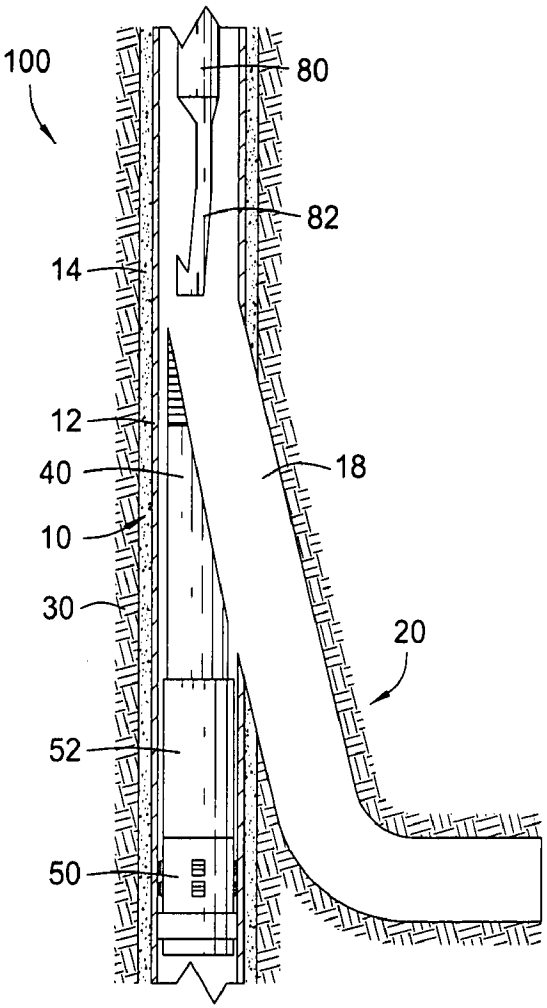
FIG. 1E (PRIOR ART)
Figure 1D:
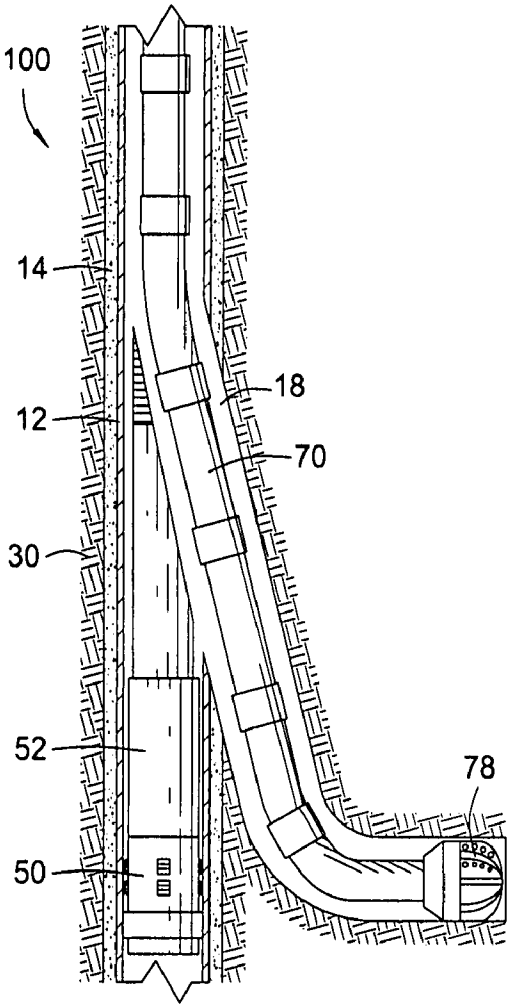
FIG. 1D (PRIOR ART)
Figure 2A:
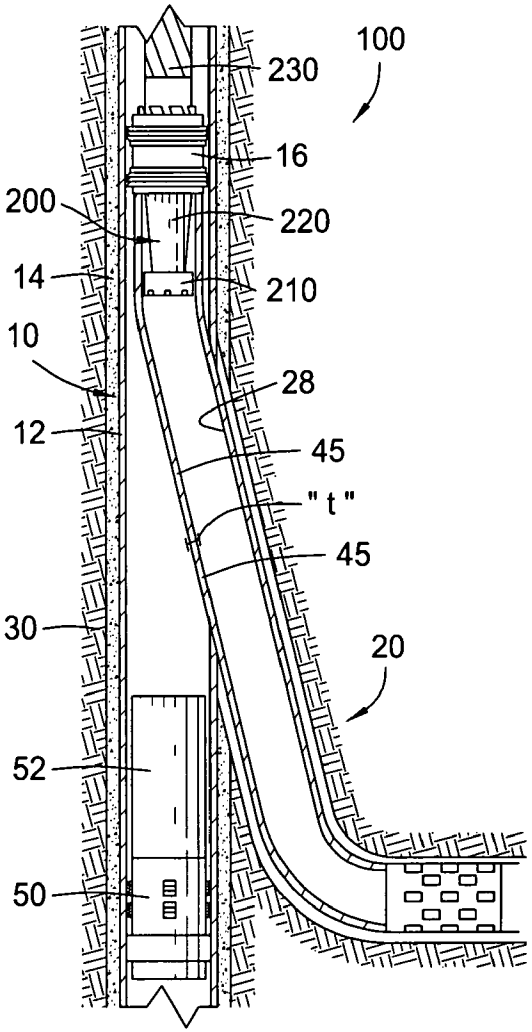
FIG. 2A is a cross-sectional view of a wellbore. The wellbore has both a primary wellbore and a lateral wellbore having been drilled off of the primary wellbore. A liner is visible providing access to the lateral wellbore through a window. A bottom hole assembly is being moved into the primary wellbore.
Figure 1G:
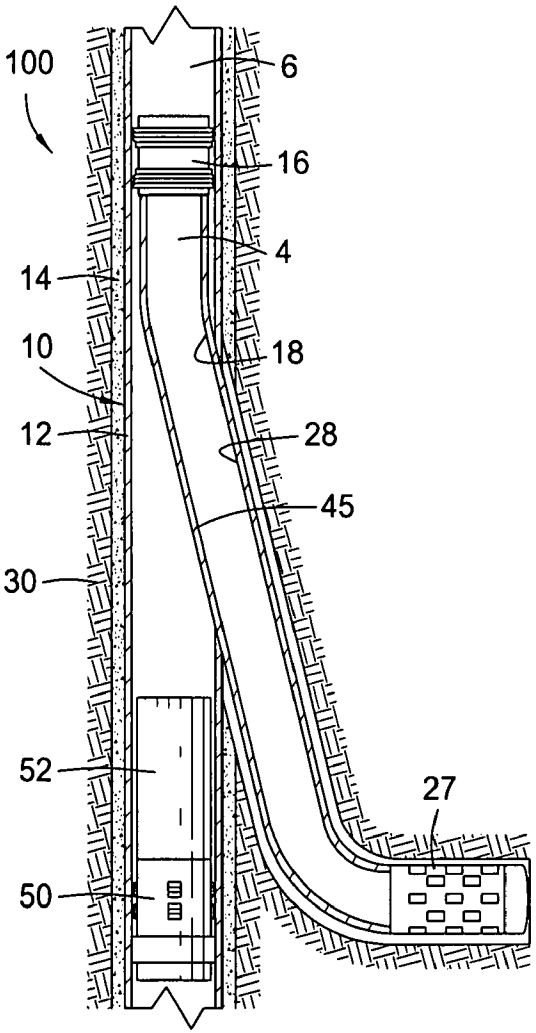
FIG. 1G (PRIOR ART)

FIG. 2A is a cross-sectional view of a wellbore 100. The wellbore 100 has both a primary wellbore 10, and a lateral wellbore 20 having been drilled off of the primary wellbore 10. A liner 28 is visible, providing access to the lateral wellbore 20 through a window 18. The liner 28 includes a curved portion 45, or "curvature," that substantially blocks passage through the primary wellbore 10 at the point of intersection with the lateral wellbore 20.

In FIG. 2A, a bottom hole assembly 200 is being moved into the primary wellbore 10. The bottom hole assembly 200 is not completely visible, but is just beginning to enter the liner 28. It is understood, of course, that the features of FIG. 2A are not to scale, and that the liner 28 may extend from 100 to 500 feet, depending upon desired build-rate.

Figure 3:
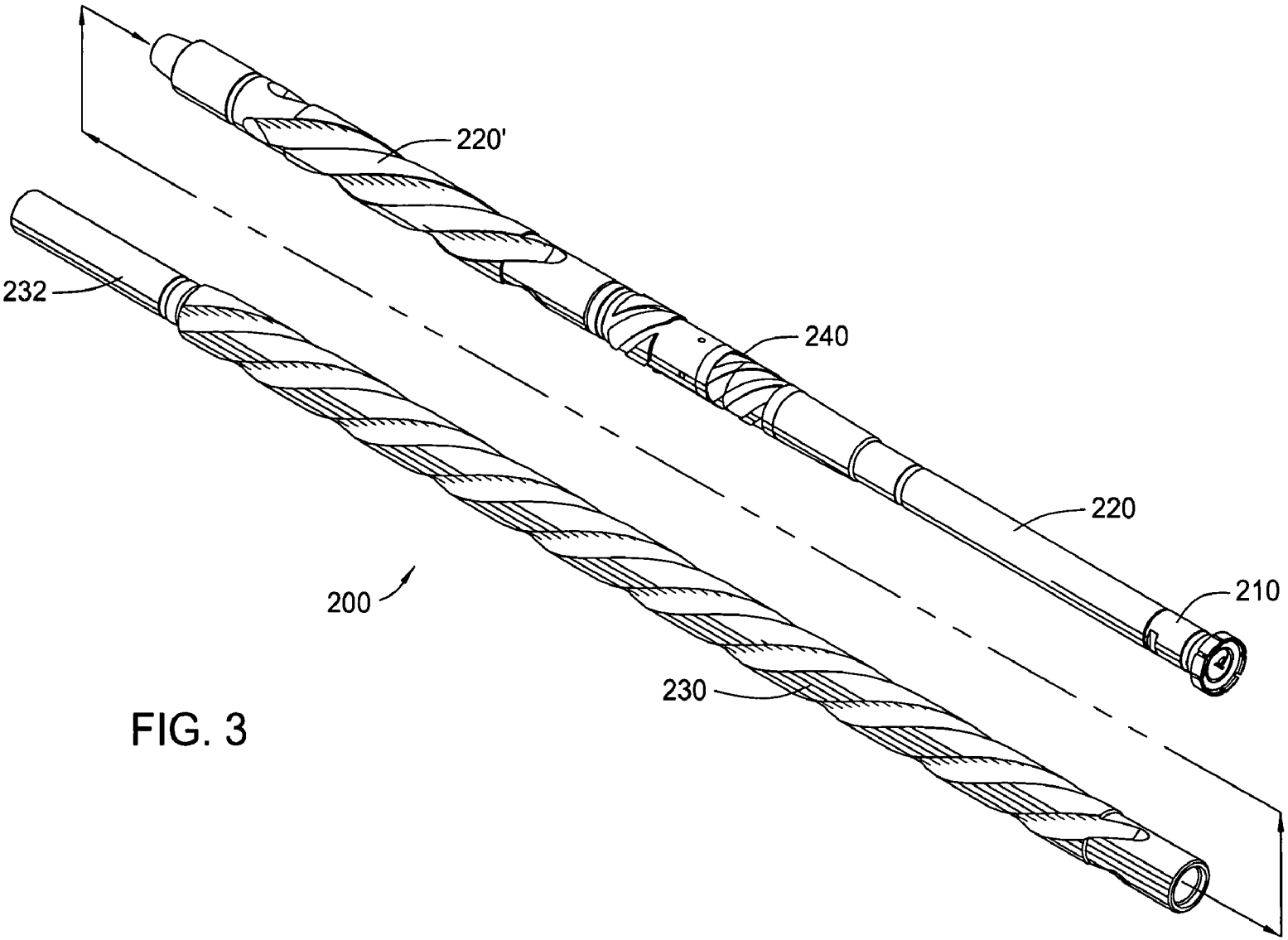
FIG. 3 provides a perspective view of a bottom hole assembly for forming a re-entry path through a tubular such as a lateral wellbore liner, in one embodiment. The bottom hole assembly includes a lead mill.

FIG. 3 provides a perspective view of a bottom hole assembly 200 for forming an entry path through a tubular body, in one embodiment. In this arrangement, the bottom hole assembly 200 includes various components, including an elongated, heavy pipe structure 230, a pair of extension subs 220, 220' connected to the pipe structure 230, an upper mill 240, and a lead mill 210. The bottom hole assembly 200 is configured to be run into a wellbore 100 on working string (not shown). Non-limiting examples of a working string include a string of drill pipe, and coiled tubing. In the event of coiled-tubing, a downhole rotary motor (not shown) would be needed to impart rotation to the bottom hole assembly 200.

Figure 4:
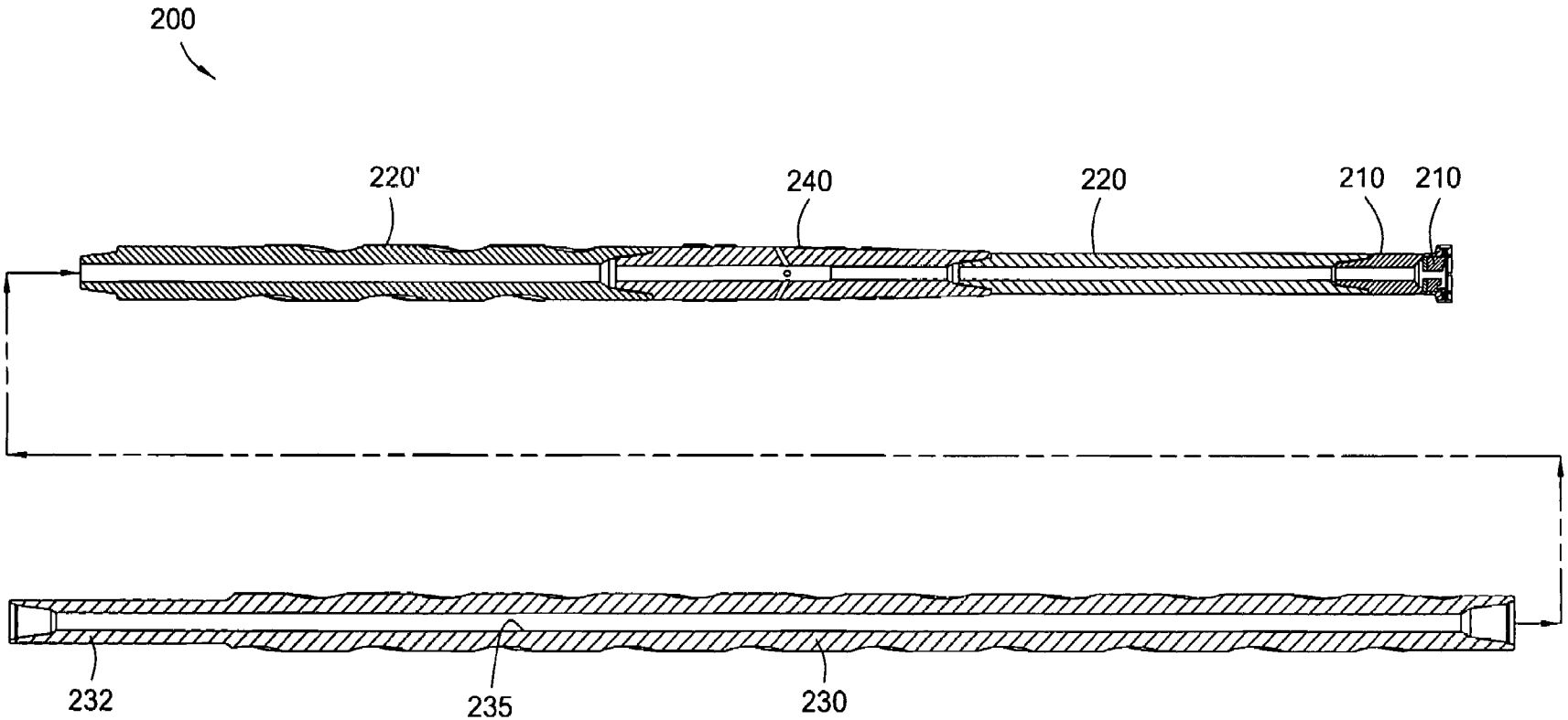
FIG. 4 presents a cross-sectional view of the bottom hole assembly of FIG. 3.

FIG. 4 shows the bottom hole assemble 200 in cross-section. First, the bottom hole assembly 200 includes an elongated, heavy pipe structure 230. This pipe structure 230 is preferably defined by one or more drill collars, as shown in FIG. 3. The drill collars 230 are fabricated from a sturdy metal to imbue substantial stiffness to the bottom hole assembly 200. The drill collars 230 also have an outer diameter that provides close tolerance within the inner diameter of the surrounding liner 28. For example, 7⅝" liner has an inner diameter of 6⅜". Drill collars 230 having an outer diameter of 6⅛" would then be preferred. The drill collars 230 also include a bore 235 along the longitudinal axis.

Fluids are circulated through an inner bore (not shown) of the drill collars 230. The fluid circulation serves to remove metal shavings and cuttings during the tubular milling process. Fluid circulation also serves to cool the milling bit 210 during milling. Milling fluids are circulated through the bore of the drill collars 230, through the milling bit 210, and back up an annular region between the assembly 200 and the surrounding liner 28. Because of the close annular tolerance of the heavy pipe structure 230, helical grooves are preferably formed around the pipe structure 230, e.g., drill collars.

During run-in for the bottom hole assembly 200, the drill collars 230 are connected to the working string. Preferably, a threaded connection is provided for connecting the one or more drill collars 230 to a working string. A fishing neck 232 is also seen on the drill collars 230.

As noted, the bottom hole assembly 200 also includes at least one sub. In the arrangement of FIG. 3, two extension subs 220, 220' are shown connected below the drill collars 230. The subs 220, 220' are preferably undersized, meaning that they provide an outer diameter that is smaller than lateral cutting structures of the lead mill 210 (to be discussed further, below). Sub 220 is shown as having a tapered outer diameter such that the outer diameter becomes smaller from the drill collars 230 as the sub approaches the lead mill 210.

The bottom hole assembly 200 may also include an upper mill. In the arrangement of FIG. 3, an upper mill is shown at 240. The upper mill 240 is preferably configured as a watermelon mill. However, the upper mill 240 is optional, as it is preferred that the lead mill 210 be sized to provide a full-bore access into the primary wellbore 10.

Figure 5:
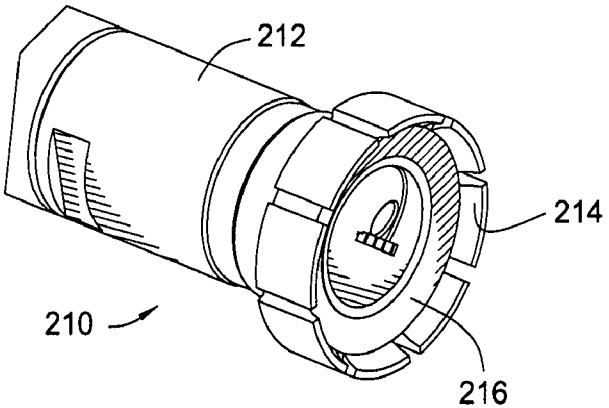
FIG. 5 presents a perspective view of the lead mill of FIG. 3.
Figure 6:
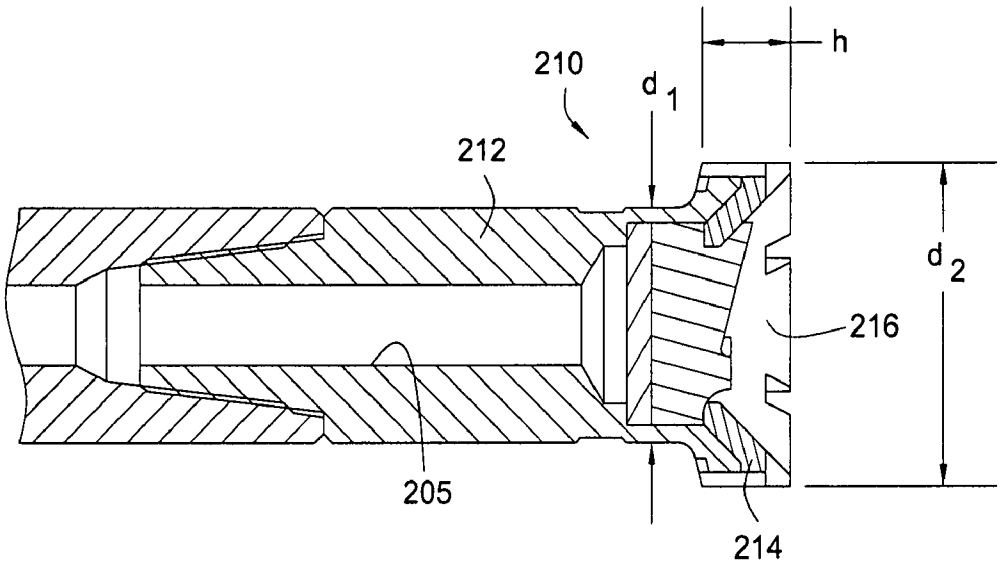
FIG. 6 shows an enlarged, side cross-sectional view of the lead mill of FIG. 3.

As noted, the bottom hole assembly 200 also includes a cutting device such as a lead mill 210. FIG. 5 presents a perspective view of the lead mill of FIG. 3, in one embodiment. FIG. 6 provides an enlarged cross-sectional view of the lead mill 210, amplifying certain features of the lead mill 210. The lead mill 210 first includes a body 212. A bore 205 runs through the body 212. The body 212 has an outer diameter, shown in FIG. 6 as "$d_1$." Connected to the body 212 are cutting structures 214. In the arrangement of FIG. 6, the cutting structures 214 represent radially arranged blades. Hardened material (not shown) is imbedded into the cutting structures 214. A non-limiting example of such a hardened material is the welding of carbide onto the blades 214.

The one or more blades 214 form a second outer diameter "$d_2$" for the lead mill 210. In addition, the one or more blades 214 define a length "h". The preferred dimensions for $d_1$ and $d_2$ are relative to the thickness of the tubular being breached, e.g., liner 28. The wall 28 has a thickness "t" (see FIG. 2A), and preferably:

$$1 \leqq [(d_2 - d_1) \div 2t] \leqq 2.5.$$

In addition, preferably:

$$(d_2 \div h) \geqq 2.0.$$

Referring again to FIG. 5, FIG. 5 presents a perspective view of the lead mill of FIG. 4. This perspective view allows for a view of the bottom of the lead mill 210. More specifically, the face 216 of the mill 210 is visible. It can be seen that the face 216 of the mill 210 is tapered. As will become more apparent herein, the preferred tapered aspect of the face 216 enables the lead mill 210 to continue to act against the liner 28 during a mill-through operation after initial breakthrough in the curvature 45, and to resist "kicking out" into the lateral wellbore 20.

To aid in the milling operation, the bottom hole assembly 200 is configured to apply a lateral pressure against the liner 28. In this respect, the elongated heavy pipe structure 230 creates stiffness in the bottom hole assembly 200. This, in turn, creates resistance to deflection in the sub 220 and lead mill 210 as it encounters the curvature 45 of the liner 28. The bottom hole assembly 200 employs simultaneous rotational and lateral force to totally breach the adjacent liner 28. thereby forming the lip. Stated another way, the bottom hole assembly 200 provides lateral forces to provide load on the cutting structure in order to complete wall penetration through the adjacent liner prior to axial movement of the rotated milling assembly 200.

For some pipe, a contact pressure greater than 115 psi is required to mill through its thickness. Therefore, in one embodiment, the bottom hole assembly 200 is configured to generate lateral force sufficient to provide a cutting surface contact pressure greater than 115 psi at any cutting depth through the casing wall "t". Specifically, $$115\ psi \leq \frac{6EI\delta}{L^3 \phi \pi h}$$

δ=deflection of mill head in liner curvature from the intended straight path at contact point (in inches);

L=length of milling assembly to a second point of contact with the liner, where an opposing lateral force is supplied (in inches);

E=modulus of elasticity (psi);

I=moment of inertia of the milling assembly between the contact points (in inches$^4$);

Ø=milling head diameter (in inches) (referred to as "$d_2$," above); and h=cutting structure length (in inches).

In addition to the stiffness of the bottom hole assembly 200 as provided by (1) the length of the drill collars 230; (2) the stiffness of the drill collars 230; and (3) the tight tolerance of the drill collars 230 within the surrounding liner 28, other features of the bottom hole assembly 200 aid in generating the desired lateral force against the surrounding liner 28. For example, the limited blade length "h" serves to direct pressure against the liner 28 at a more precise point by reducing the milling contact area. Also, the tapered configuration of the lower sub 220 avoids interference of pipe structure with the lateral cutting function of the lead mill 210 during milling. In addition, the ratio of plunge-through depth [($d_2$−$d_1$/2)]) to liner wall thickness "t" is between 1 to 1and 2.5 to 1 (inclusive). This configuration uniquely allows the mill 210 to relieve the bending loads, e.g. cut through the liner 28, without supporting the mill 210 with additional contact area.

The step of applying the lateral pressure through the milling bit against the curvature of the liner is provided at least in part by the moment force applied by stiffness within the drill collar 230 and connected sub 220. The milling bit 210 is lowered to a first desired depth in the primary wellbore 10 so that an outer edge of the milling bit cutting structure 214 is in contact with the wall 45. The operator may be observing weight indicators, first movements, and/or monitoring depth to position the milling bit 210 below the beginning of the liner curvature 45. The milling bit 210 is then rotated until the wall "t" is entirely breached at a point, thereby forming the lip.

Figure 2C:
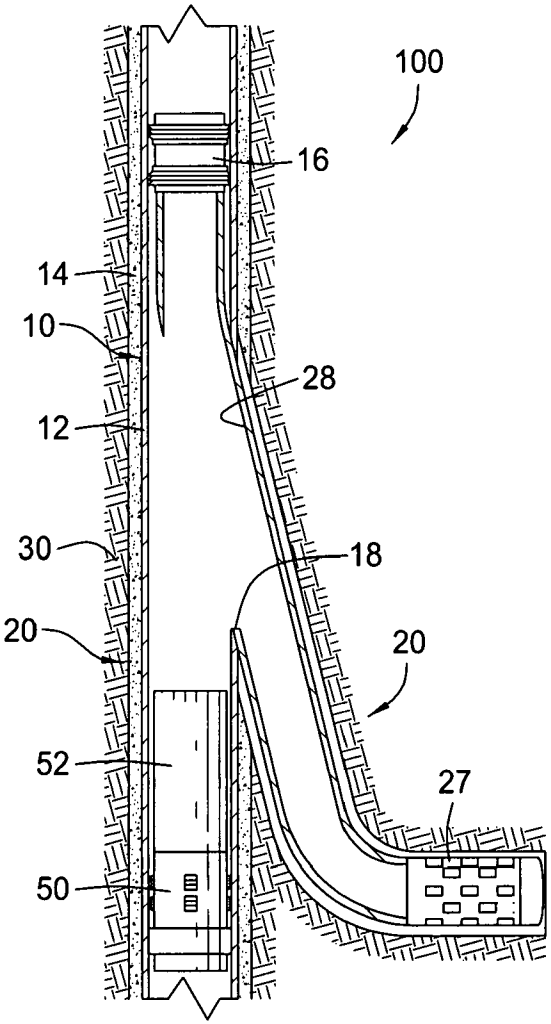
FIG. 2C shows the wellbore of FIG. 2B, with the bottom hole assembly having been removed. The packer remains in the primary wellbore, waiting to be milled out or otherwise removed for final access to the primary wellbore below the window.
Figure 2B:
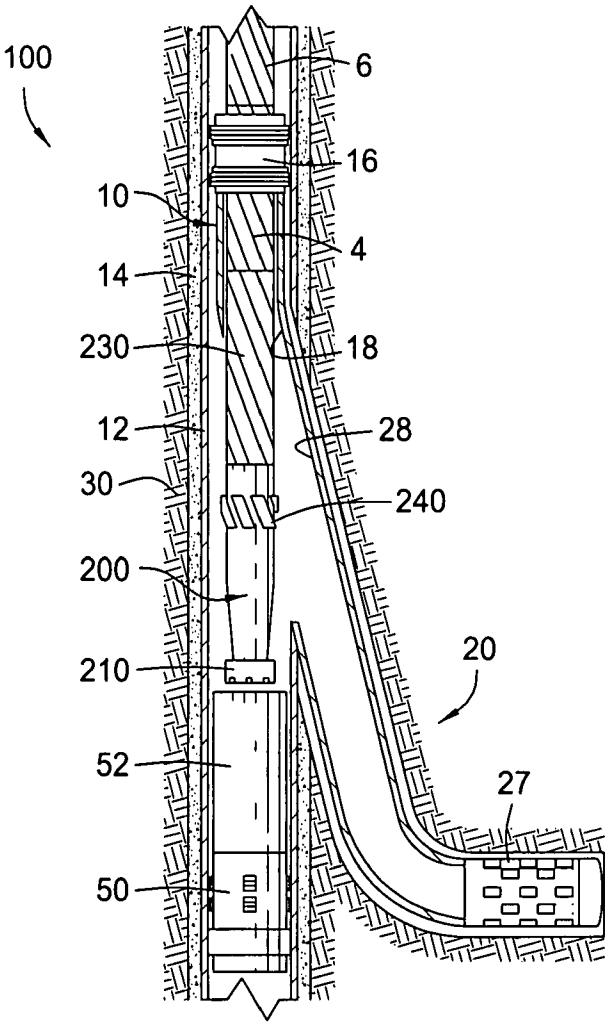
FIG. 2B provides another cross-sectional view of the wellbore of FIG. 2A. This view represents a next step in the creation of a re-entry path through the liner in the primary wellbore. In this step, the bottom hole assembly has milled through the liner, forming the re-entry path.

Turning now to FIG. 2B, FIG. 2B provides another cross-sectional view of the wellbore 100 of FIG. 2A. This view represents a next step in the creation of a re-entry path through the liner 28 in the primary wellbore 10. In this step, the bottom hole assembly 200 has milled through the liner 28, forming the re-entry path into the primary wellbore 10. After forming the lip through the liner wall 45, the working string and attached milling bit are advanced axially so that a first re-entry path is formed in the primary wellbore 10. These steps may be repeated for additional lateral junctions.

FIG. 2C shows the wellbore of FIG. 2B, with the bottom hole assembly having been removed. The packer 50 remains in the primary wellbore 10. The packer 50 and supported orientation anchor remain in the primary wellbore 10. Where desired for additional completion operations for the lateral wellbore 20, a re-entry guide (not shown) may be landed on the anchor 50 to aid in directing tools into the lateral wellbore 20. Where the liner 28 has been cemented in place, an undergauge rock bit (not shown) with near-gauge smooth outer diameter stabilizer may be used to form a bore through the packer 50. The packer 50 may later be completely milled out for final access to the primary wellbore 10 below the window 18. Where the liner 28 has not been cemented into the primary wellbore 10, the packer 50 may be released and pulled out of the hole after lateral completion operations are performed.

By way of example, a 7-inch liner may be hung within a size 9-⅝-inch casing. The 7-inch liner has a 6.184 inch i.d., and receives a 6.125-inch diameter spiraled drill collar. In this way, minimal flexure and maximum stabilization of the drill collar is obtained. The special collar incorporates a non-flat surface, e.g., outer spirals, in order to expand the return flow area. The large collar diameter yields a significant "bending" force, or moment, that permits a substantial lateral cutting force to be applied against the liner.

In one test, it was found that in a liner curvature formed from a 15° per hundred-build rate, with a mill being run to a depth of 1 foot below the top of the beginning of the liner radius, a side force of about 8900-lbs was created. In previous tests, the mill breakthrough was achieved upon rotation within 15 minutes. In a 25° per hundred-build rate, and a distance of 1 foot below the top of the liner curvature, a side force of 5,650-lbs may be created. In previous tests, the mill breakthrough in this instance was achieved within 44 minutes after beginning rotation. These test results were achieved without the installation of centralizers to align milling centerlines.

Figure 7:
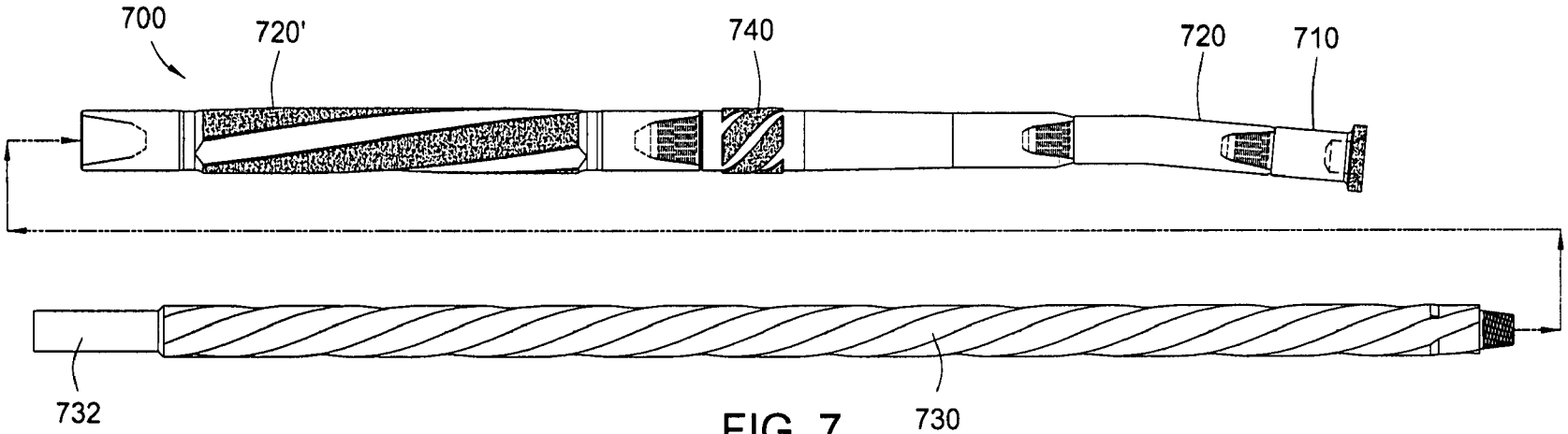
FIG. 7 presents a plan view of a bottom hole assembly, in an alternate arrangement. In this arrangement, the assembly includes an angled tool joint to deflect the lead mill.

Alternate bottom hole assembly configurations may be employed with the above-described methods to provide additional deflection force. FIG. 7 presents a plan view of a bottom hole assembly 700 in an alternate arrangement. The assembly 700 may generally include the tools from the assembly 200 of FIG. 4. These include a heavy pipe structure 730 such as drill collars, a fishing neck 732, a pair of extension subs 720, 720' connected to the drill collars 730, an upper mill 740, and a lead mill 710. The bottom hole assembly 700 is again configured to be run into a wellbore 100 on working string (not shown). However, in this arrangement, one of the tools is bent in order to produce a slightly eccentric rotation of the lead mill 710 during rotation of the bottom hole assembly 700. By bending the tool, an angled tool joint along the assembly 700 is produced. The angled tool joint may be the upper mill 740 or one of the subs 720, 720'. In the arrangement of FIG. 7, the angled tool joint is the sub 720. The bent sub 720 provides additional deflection force for the mill 710 against the liner curvature 45 when the assembly 700 is rotated.

Figure 8:
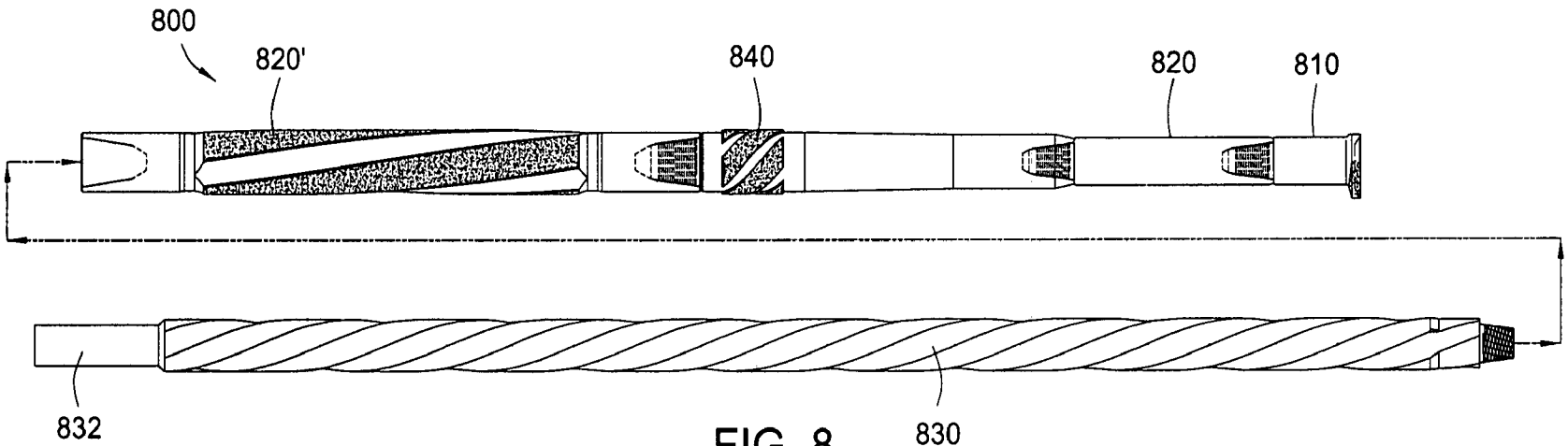
FIG. 8 provides a plan view of a bottom hole assembly in yet an additional alternate embodiment. In this embodiment, the assembly includes a mill with an eccentrically arranged cutting structure.

FIG. 8 provides a plan view of a bottom hole assembly 800 in yet an additional alternate embodiment. The assembly 800 may again include tools from the assembly 200 of FIG. 4. These include a heavy pipe structure 830 such as drill collars, a fishing neck 832, a pair of extension subs 820, 820' connected to the drill collars 830, an upper mill 840, and a lead mill 810. However, in this arrangement, the lead mill 810 has an eccentrically arranged cutting structure 814 relative to a longitudinal axis of the mill 810. The offset cutting structure 814 in FIG. 8 will increase the lateral load on the cutting structure 814 by amplifying the deflection of the mill 810 against the curvature 45.

In another embodiment of a method for forming a re-entry path, an additional step of applying a lateral pressure through the milling bit 210 against the curvature 45 of the liner 28 while rotating the milling bit 210 is provided. This may be accomplished through a centralizing mechanism, such as a hydraulically activated directional drilling tool. Once a lip is formed, weight and rotation are used to fully develop a re-entry path of some desired length. This path may be fully produced in either one or multiple trips. The use of a large diameter mill helps avoid the requirement of additional trips and/or mills to enlarge pilot openings.

Various methods of removing lateral material for creating access to a main wellbore below a lateral wellbore are provided. Generally, the steps include locating a cutting device adjacent a portion of the wall within the wellbore. The cutting device is rotated while its axial position is maintained relative to the wall. Lateral force from the cutting device is used to initiate an opening in the wall. Thereafter, the cutting device is rotated and advanced axially within the primary wellbore to complete the opening. This method, in one embodiment, is used to provide access to the primary wellbore after a plurality of lateral wellbores has been formed, with each lateral wellbore having a tubular passing from the primary wellbore into respective lateral wellbores. The cutting device in this instance removes material from the curvature of a liner at the intersection of the primary wellbore and the lateral wellbores. Preferably, the cutting device is a milling bit that is introduced into the primary wellbore at the end of a working string. The milling bit may be a part of the bottom hole assembly 200 as described above, such as the assembly 200 shown in FIG. 3.

As can be seen, the present invention provides a method by which complete re-entry or access into a parent wellbore below the intersection of the parent wellbore with a lateral wellbore may be accomplished. A "re-entry path" is formed to provide access for the passage of tools as well as the flow of fluids between an upper portion and a lower portion of the parent wellbore. Preferably, the re-entry path has an inner diameter that approaches the drift diameter of the liner of the lateral wellbore located above the intersection of the parent and lateral wellbores. In this way, the diameter of the re-entry oath is large enough to allow the passage of tools into the parent wellbore below the intersection, including, but not limited to. monitoring, pressure control, reworking, and stimulating tools. Thus, upon completion of the re-entry path at the intersection of the parent wellbore and a lateral wellbore, the parent wellbore and that lateral wellbore have "equivalent" inner diameters for full-bore access of downhole tools.

The milling assembly configurations described above require no hydraulics for centralization nor other extraneous mechanisms to urge a lateral cutting action. The above-described milling assembly configuration 200 simulates the radius of liner at its juncture achieving minimum flexure while operational in a curved tubular and allowing the mill to breach this liner. At the same time, additional lateral forces may optionally be generated through the use of a biasing mechanism or directional drilling device.

In another embodiment, the method further comprises the step reciprocating the milling bit along a length of the curvature of the liner while rotating the milling bit. The reciprocating action may be conducted prior to the step of rotating the cutting device while maintaining an axial position of the cutting device relative to the wall. Alternatively, the reciprocating action may be conducted after the lip in the wall has been formed. In this respect, testing has demonstrated that it is possible to "skip over" the lip by adding weight and slowly rotating. Alternatively, more than one lip may be formed along the curvature before or after shaving. Continued lowering and reciprocation of the assembly 200, with or without rotation, against the inside tubular curvature utilizes the stored energy of the milling assembly 200 to create a side force to reduce the wall thickness. In this manner, an inner portion of the liner is "pre-shaved," thereby assisting the milling process. Where the lip has already been formed prior to shaving, the milling assembly 200 would have to be raised back to the point of the initial breach for complete milling.

The above described methods may be used with known mills and liner materials. The above described methods may eliminate the need for expensive junction equipment and the associated complex cementing procedures used in many "ML Level 4" systems.

The methods also allow for stacked ML systems, without the continual reduction of the mainbore diameter. In this respect, more than one lateral wellbore can be directed from a portion of the parent wellbore having a particular diameter casing, each lateral wellbore being cased by an internal liner having the same inner diameter. The lateral wellbores are generally, successively completed starting from the downhole side of the portion of the parent wellbore. After a particular lateral wellbore is completed, as described above, then a new lateral wellbore can be extended from the parent wellbore at a location above the previously-completed wellbore. Once each lateral wellbore extending from the parent wellbore is completed, the operator would have full-bore access for the passage of the same-sized downhole tools to any equivalent-bore lateral wellbore or the parent wellbore.

While the foregoing is directed to embodiments of the present invention, other and further embodiments of the invention may be devised without departing from the basic scope thereof, and the scope thereof is determined by the claims that follow.

The invention claimed is:

1. A method of creating an opening in a wall of a tubular within a wellbore, comprising:

locating a cutting device adjacent a portion of the wall within the wellbore;

rotating the cutting device while maintaining an axial position of the cutting device relative to the wall to initiate the opening; and rotating and axially advancing the cutting device to complete the opening, wherein:

the wall has a curvature;

the cutting device is located along the curvature;

the cutting device is part of a bottom hole assembly; and a stiffness of the bottom hole assembly, a contact area of the cutting device and the location of the cutting device along the curvature are selected so that a contact pressure of greater than or equal to 115 psi is maintained while initiating the opening.

2. The method of claim 1, wherein the cutting device is a milling bit and the step of locating the cutting device comprises the steps of:

placing the milling bit proximate a lower end of a working string; and running the milling bit and connected working string to a desired depth within the wellbore.

3. The method of claim 2, wherein the step of rotating the cutting device while maintaining an axial position of the cutting device relative to the wall to initiate the opening is continued until the wall is breached.

4. The method of claim 1, wherein:

the cutting device is a milling bit; and the tubular is a liner secured at the intersection of a primary wellbore and a lateral wellbore.

5. The method of claim 4, wherein the step of rotating the cutting device while maintaining an axial position of the cutting device relative to the wall to initiate the opening is continued until the liner is breached, thereby forming a lip.

6. The method of claim 5, wherein the step of rotating and axially advancing the cutting device to complete the opening comprises rotating and axially advancing the milling bit along a desired length of the liner to form a re-entry path in a primary wellbore.

7. The method of claim 4, further comprising the step of:

actuating a biasing mechanism to apply additional lateral pressure against the curvature of the liner while rotating the milling bit to initiate the opening.

8. The method of claim 7, further comprising the step:

reciprocating the milling bit along a length of the curvature of the liner while rotating the milling bit prior to the step of rotating the cutting device while maintaining an axial position of the cutting device relative to the wall, thereby shaving an inner portion of the liner.

9. The method of claim 7, wherein:

the step of locating a cutting device adjacent a portion of the wall within the wellbore comprises locating the milling bit at a first point along the curvature of the liner; and the step of rotating the cutting device while maintaining an axial position of the cutting device relative to the wall to initiate the opening comprises forming a first lip at the first point along the curvature of the liner;

and wherein the method further comprises:

locating the milling bit adjacent a second point along the curvature of the liner after forming the first lip; and rotating the milling bit while maintaining an axial position of the milling bit relative to the liner to initiate an opening, thereby forming a second lip at a second point along the curvature of the liner.

10. The method of claim 5, wherein the contact pressure is determined using the formula $$\frac{6EI\delta}{L^3\phi\pi h},$$

where: $\delta$ is a deflection of a head of the milling bit in the curvature from an intended straight path at a contact point (in inches), L is a length of the bottom hole assembly to a second contact point with the liner where an opposing lateral force is supplied (in inches); E is a modulus of elasticity (in psi) of the bottom hole assembly, I is a moment of inertia of the bottom hole assembly to the contact point (in inches$^4$), $\phi$ is an outside diameter of the head of the milling bit (in inches); and h is a cutting structure length of the milling bit (in inches).

11. The method of claim 5, wherein an outside diameter of at least a portion of the bottom hole assembly is slightly less than an inside diameter of the liner.

12. The method of claim 11, wherein slightly is less than or equal to one-quarter inch.

13. The method of claim 12, wherein slightly is less than or equal to 0.059 inch.

14. The method of claim 1, wherein: the bottom hole assembly comprises:

an elongated, heavy pipe structure connected proximate an end of a working string; and a sub connected to the heavy pipe structure at an end opposite the working string, the sub also being connected to the cutting device at an end opposite the heavy pipe structure.

15. The method of claim 14, wherein the sub has an outer diameter that is smaller than the outer diameter of cutting blades along the cutting device.

16. The method of claim 15, wherein the outer diameter of the sub is generally tapered to become smaller from the heavy pipe structure to the cutting device.

17. The method of claim 15, wherein the sub is bent to produce an eccentric rotation of the lead mill when the bottom hole assembly is rotated.

18. The method of claim 15, wherein the cutting device has eccentrically arranged cutting structures to provide an additional moment force against the wall when the bottom hole assembly is rotated.

19. The method of claim 14, wherein the heavy pipe structure is one or more drill collars.

20. The method of claim 14, wherein:

the bottom hole assembly further comprises a hydraulically actuated centralizing mechanism; and lateral pressure exerted by the cutting device against the wall is further generated by actuating the centralizing mechanism.

21. The method of claim 14, wherein:

the bottom hole assembly further comprises a biasing means; and lateral pressure exerted by the cutting device against the wall is further generated by actuating the biasing means.

22. The method of claim 1, wherein the cutting device is a lead mill, the lead mill comprising:

a body having an inner bore and a first outer diameter "$d_1$"; and one or more blades at a point along the outer diameter of the body, the blades forming a second outer diameter "$d_2$" and having a length "h".

23. The method of claim 22, wherein:

the wall has a thickness "t"; and $$1 \leqq [(d_2-d_1) \div 2t] \leqq 2.5.$$

24. The method of claim 22, wherein:

$$(d_2 \div h) \geqq 2.0.$$

25. The method of claim 22, wherein the blades are eccentrically arranged relative to a longitudinal axis of the body.

26. A method of removing a portion of a liner at the intersection of a lateral wellbore and a primary wellbore in order to permit access to the primary wellbore below the lateral wellbore, the method comprising the steps of:

running a milling assembly into the primary wellbore, the milling assembly having a lead mill comprising:

a body having an inner bore and a first outer diameter "$d_1$";

one or more blades at a point along the outer diameter of the body, the blades forming a second outer diameter "$d_2$" and having a length "h";

engaging the milling assembly to a portion of the liner obstructing the primary wellbore;

rotating the milling assembly at a point along the curvature;

using lateral forces created by the milling assembly contacting the liner to provide load on the cutting structure in order to complete penetration through a wall of the liner prior to axial movement of the milling assembly;

axially moving downward and further rotating the milling assembly to mill through the liner and to form a re-entry into the primary wellbore, wherein:

the wall has a thickness "t";and $$1 \leqq [(d_2-d_1) \div 2t] \leqq 2.5.$$

27. The method of claim 26, wherein:

$$(d_2 \div h) \geqq 2.0.$$

28. The method of claim 26, wherein the lead mill further comprises a concave inner face.

29. The method of claim 26, wherein the milling assembly further comprises a drill collar, and an extension sub connected to the drill collar.

30. The method of claim 29, wherein the milling assembly further comprises an upper mill intermediate the drill collar and the extension sub.

31. A bottom hole assembly for laterally milling a lip in a tubular body having a wall, the bottom hole assembly comprising:

a drill collar;

a sub connected to the drill collar; and a lead mill, the lead mill comprising:

a body connected to the sub, and having an inner bore and a first outer diameter "$d_1$";

one or more cutting surfaces at a point along the outer diameter of the body, the cutting surfaces forming a second outer diameter "$d_2$" and having a length "h";

wherein:

the wall has a thickness "t"; and $$1 \leqq [(d_2-d_1) \div 2t] \leqq 2.5.$$

32. The bottom hole assembly of claim 31, wherein:

$$(d_2 \div h) \geqq 2.0.$$

33. The bottom hole assembly of claim 31, wherein the lead mill further comprises a concave inner face.

34. The bottom hole assembly of claim 31, wherein the sub has an outer diameter that is smaller than the outer diameter of the cutting surfaces along the lead mill.

35. The bottom hole assembly of claim 34, wherein the outer diameter of the sub is generally tapered to become smaller from the drill collar to the lead mill.

36. The bottom hole assembly of claim 34, wherein the sub is bent.

37. The bottom hole assembly of claim 31, wherein:

the drill collar and connected sub form a longitudinal axis of the bottom hole assembly; and the cutting surfaces of the lead mill are eccentrically arranged relative to the longitudinal axis.

38. The bottom hole assembly of claim 31, further comprising:

an upper mill disposed between the sub and the drill collar.

39. A bottom hole assembly for laterally milling a lip in a tubular body, the bottom hole assembly comprising:

a drill collar;

a sub connected to the drill collar; and a lead mill, the lead mill comprising:

a body connected to the sub, and having an inner bore and a first outer diameter "$d_1$";

one or more cutting surfaces at a point along the outer diameter of the body, the cutting surfaces forming a second outer diameter "$d_2$" and having a length "h", wherein:

the sub has an outer diameter that is smaller than the outer diameter of the cutting surfaces along the lead mill; and the outer diameter of the sub is generally tapered to become smaller from the drill collar to the lead mill.

40. A method of re-entering a primary wellbore lined with casing from an intersection with a lateral wellbore lined with a liner, comprising:

running a bottom hole assembly (BHA) into the primary wellbore, the BHA comprising:

a milling bit, and a drill collar having an outside diameter slightly less than an inside diameter of the liner, wherein slightly is less than or equal to one-quarter inch:

locating the milling bit along a curvature of the liner, wherein the drill collar engages the liner and provides a lateral force on the milling bit against the liner;

rotating the milling bit while maintaining an axial position of the milling bit relative to the liner to initiate an opening through the liner; and rotating and axially advancing the milling bit to complete the opening.

41. The method of claim 40, wherein slightly is less than or equal to 0.059 inch.

42. The method of claim 40, wherein the milling bit is rotated and axially maintained until the liner is breached, thereby forming a lip.

* * * * *